US006662530B1

(12) United States Patent
Millon et al.

(10) Patent No.: US 6,662,530 B1
(45) Date of Patent: Dec. 16, 2003

(54) METHOD OF MAKING DUAL CHAMBER SACHET

(75) Inventors: Joel Millon, Westfield, NJ (US); Orlando Fuquen, Princeton, NJ (US); Christopher Joseph Miller, Flemington, NJ (US); Scott Murray Walsh, Hackettstown, NJ (US)

(73) Assignee: Colgate-Palmolive Company, New York, NY (US)

( * ) Notice: Subject to any disclaimer, the term of this patent is extended or adjusted under 35 U.S.C. 154(b) by 33 days.

(21) Appl. No.: 09/714,751

(22) Filed: Nov. 16, 2000

(51) Int. Cl.[7] ..... B65B 9/00

(52) U.S. Cl. ..... 53/450; 53/449; 53/554; 222/94

(58) Field of Search ..... 53/450, 449, 451, 53/554; 156/553, 582, 583.4; 206/219, 484; 493/196, 201, 210, 213; 222/94

(56) References Cited

U.S. PATENT DOCUMENTS

| | | | | |
|---|---|---|---|---|
| 2,401,110 A | | 5/1946 | Rohdin | 229/65 |
| 2,913,861 A | * | 11/1959 | Macneale | 206/484 |
| 3,239,105 A | | 3/1966 | Woodson | 221/94 |
| 3,290,422 A | * | 12/1966 | Michel | 264/259 |
| 3,391,047 A | * | 7/1968 | Kopp | 156/553 |
| 3,396,836 A | | 8/1968 | Grant et al. | 206/63.2 |
| 3,469,768 A | * | 9/1969 | Repko | 174/DIG. 11 |
| 3,506,157 A | * | 4/1970 | Dukess | 222/563 |
| 3,891,138 A | | 6/1975 | Glas | 229/56 |
| 4,312,473 A | | 1/1982 | Hoeller | 229/56 |
| 4,512,136 A | * | 4/1985 | Christine | 383/122 |
| 4,732,299 A | | 3/1988 | Hoyt | 222/94 |
| 5,269,441 A | * | 12/1993 | O'Meara | 215/6 |
| 5,316,400 A | | 5/1994 | Hoyt et al. | 401/132 |
| 5,318,203 A | * | 6/1994 | Iaia et al. | 222/94 |
| 5,494,190 A | | 2/1996 | Boettcher | 222/1 |
| 5,628,429 A | * | 5/1997 | Usen et al. | 222/1 |
| 5,709,479 A | * | 1/1998 | Bell | 383/10 |
| 5,927,550 A | * | 7/1999 | Mack et al. | 222/94 |
| 6,164,822 A | | 12/2000 | Beer | 383/38 |
| 6,176,395 B1 | * | 1/2001 | Abbott et al. | 222/145.1 |
| 6,223,942 B1 | * | 5/2001 | Markey et al. | 222/485 |

FOREIGN PATENT DOCUMENTS

| | | |
|---|---|---|
| FR | 2755673 | 5/1998 |
| JP | 11301745 | 11/1999 |

* cited by examiner

*Primary Examiner*—Rinaldi I. Rada
*Assistant Examiner*—Louis Tran
(74) *Attorney, Agent, or Firm*—Michael J. McGreal

(57) ABSTRACT

A dual chamber sachet with a dispensing outlet can be made in a form/fill sequence by attaching the dispensing outlet to the film that is to form the chamber divider wall followed by attaching films that are to form the outer walls of the sachet to the dispensing outlet. The upper and side lateral edges of the sachet then are sealed together to produce a sachet with an open bottom end. The sachet can be produced from three film sources, two film sources with the outer walls being formed from a single film, or from a single film formed into a W-shape. The sachet preferably is filled through the open bottom end and the bottom end then sealed. However the sachet can be top filled through the nozzle. The sachets then are severed one from the other by cutting along a lateral seal and packed into a carton, or preformatted along a lateral seal and cut to produce a string of a set number of sachets. The sachets can have a single use dispensing outlet or a reclosable dispensing outlet. Larger sachets will have a reclosable dispensing outlet.

8 Claims, 5 Drawing Sheets

METHOD OF MAKING DUAL CHAMBER SACHET

FIELD OF THE INVENTION

This invention relates to a method of making dual chamber sachets with a dispensing outlet. More particularly this invention relates to a method of making dual chamber sachets with a dispensing outlet in a form/fill process.

BACKGROUND OF THE INVENTION

Dual chamber sachets, also know as pouches or packets, are known in the art. These are shown in U.S. Pat. Nos. 2,401,110; 2,913,861; 3,239,105; 3,396,836; 3,891,138; 4,312,473; 5,316,400 and 5,494,190. However, these sachets do not have dispensing nozzles, and in particular, reclosable dispensing nozzles. Also known are various processes to make these dual chamber sachets. Such processes are shown in U.S. Pat. Nos. 3,391,047 and 3,469,768. In U.S. Pat. No. 3,391,047 the sachet is made from three films, while in U.S. Pat. No. 3,469,768, it is made from a single film which is folded to form the dual chambers. However, there is not shown in the art a technique to make a dual chamber sachet with a dispensing outlet. In particular, there is not shown in the prior art a form/fill process for making dual chamber sachets with a dispensing outlet. By the use of a form/fill technique in making and filling the dual chamber sachet in a single operation the amount of handling is decreased. Further, in a form/fill process it is easier to maintain high sanitary conditions since the films that comprise the sachet are not touched or handled prior to the forming, filling and sealing of the sachet. These advantages are achieved in the forming and filling of the sachets at rates 30 to 240 sachets per minute.

BRIEF DESCRIPTION OF THE INVENTION

The invention is directed to new processes for making a dual chamber sachet with a dispensing outlet. The new processes comprise making the dual chamber sachet in a form/fill process. The dispensing outlet can be of a one time opening type or it can be of the reclosable type.

One process for making the sachets comprises the feeding of film from three separate rolls. The film from a first and second roll will form the outer walls of the sachet. The film from a third roll forms the divider wall for the sachet. However, prior to the film from this third roll being fed between the films from the first and second rolls, a dispensing part, such as a nozzle, is attached to this film.

The dispensing part or nozzle will have at least two dispensing outlets. These outlets usually will have the same cross-sectional area, but this is not necessary. The film from the third roll is attached to a projection or recess between the two dispensing outlets of the dispensing nozzle. Preferably this attaching is by a heat bonding of the film to the projection or recess. This film with the dispensing nozzle attached then is fed between the film from the first roll and the film from the second roll. These films are bonded to exterior surfaces of the dispensing nozzle and to the periphery of the film of the third roll to form a sachet that is sealed on the dispensing end to the dispensing part and on two sides. The lower end is open for filling.

In a subsequent step in the process, the sachets then are bottom filled and sealed. In a further operation the sachets are optionally trimmed and then severed from the long string of sachets from the form/fill process to form single units which are put into cartons for shipping. As an alternative, perforation or slit can be made between sachets with a severing after a given number of sachets to form a string of sachets. In place of single sachets being displayed for sale, strings of sachets can be displayed and the desired number of sachets removed from the string at the point of sale.

Another process comprises a variation of the above process where two vertical halves of a dual dispensing nozzle are attached to opposite sides of the film from the third roll. Each nozzle part has a complete half section and will dispense a product from the sachet chamber on a side of the divider wall. As an option the vertical nozzle part halves can be of a type where the film divider wall also will form a wall of each half of the dispensing nozzle. The films then are sealed about their periphery except for the bottom which is left open for filling. After the sachet is formed and optionally filled, the sachet can be trimmed to better expose the dispensing nozzle opening of the sachet.

A further process is to fold a single sheet of film into "W" shape to form two chambers with a separate divider wall for each chamber. The center wall of the "W" shape is fitted into a groove in the dispensing nozzle or in the alternative a vertical section of the nozzle is attached to each side of the center wall of the "W" shape with the center wall of the "W" forming the divider wall for the sachet and for the dispensing nozzle. The film then is sealed about the periphery. The bottom of the sachet is cut open for fillings.

The dispensing nozzle can be for a single use outlet or can be a reclosable type. A single use outlet will be of a type where a section is broken off via a weakened point. The broken off piece is discarded. A reclosable sachet is one that has a threadedly attached, friction fitted or a flip top closure, or can be one that is of the broken off type, but where one end of the broken off piece then is used as a closure. Any of these can be used to close the dispensing outlet.

The films that form the sachet can be of the same material or a different material from each other and from the dispensing nozzle. However, the films from the first and second rolls must be bondable one to the other, and preferably heat bondable, to the film from the third roll and to the material of the dispensing outlet. Likewise, the film from the third roll must be bondable to the material of the dispensing outlet. Various polyolefins are the preferred materials.

DETAILED DESCRIPTION OF THE DRAWINGS

Figure 1:
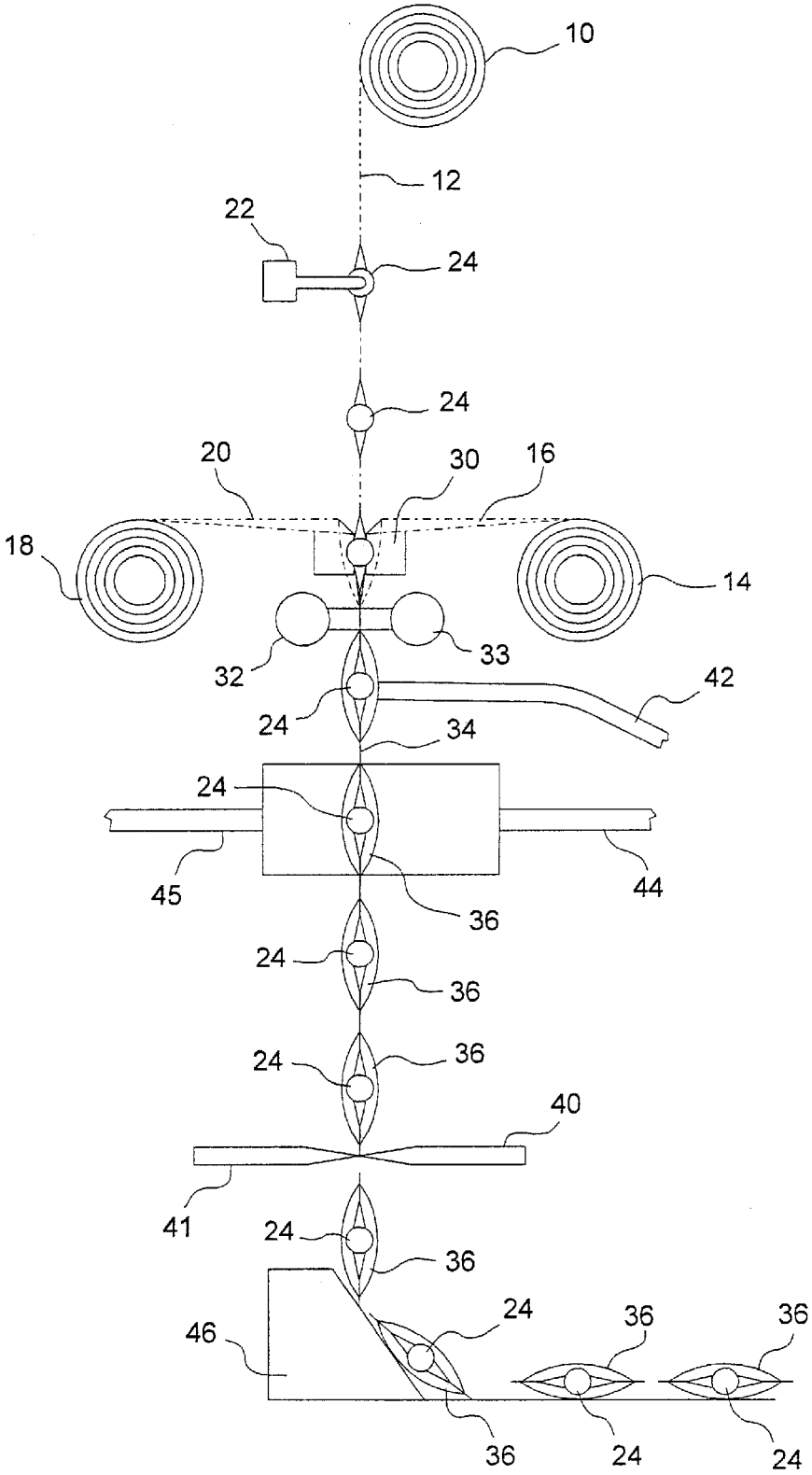
FIG. 1 is a schematic view in elevation of the form/fill process and apparatus showing the dispensing end of the sachets.

The invention will be described with reference to the preferred embodiments set out in the drawings. These embodiments describe the inventive concept which concept is not restricted to these preferred embodiments which are set out schematically in the drawings. The orientation of the process can be change with regard to the flow of the films which can from vertical to horizontal. There are no restrictions on the spatial orientation of the schematic processes or in the flow of the films.

FIG. 1 shows film rolls 10, 14 and 18. Roll 14 is a first film roll, roll 18 a second film roll and roll 10 a third film roll from which film 12 will form the divider wall of the sachet. Film 12 leaves the third film roll 10 and dispensing outlet 24 is attached at station 22. The film 12 is bonded to a projection 56 or recess 58 in a lower portion of the dispensing outlet 24 (FIGS. 3, 3A and 4), preferably by thermal bonding. Usually the nozzle will have a closure in place. The projection 56 or recess 58 is located between the two dispensing channels 51, 53. The film 12 with the dispensing outlet 24 attached is fed to sachet former 30 which guides films 16 and 20 into contact with dispensing outlet 24 and with film 12. The films 16 and 20 are bonded to the dispensing outlet 24 and to the lateral edges of film 12 to form a sachet with a dispensing outlet and an open bottom by heated jaws 32 and 33. These heated jaws move inwardly and outwardly to form the lateral edge seals 34 of the three layers of film. The sachet then is filled and the bottom edge sealed. This is shown in more detail in FIG. 2. The sachets 36 then move along to cutter 40, 41 which is comprised of two opposed knife edges that sever the film in the middle of seal 34 to form separate sachets that are directed at 46 to packing cartons or other secondary packaging operation (not shown). Optionally the sachet packets can be cut into a string of sachet packets where n is an integer of about 2 to 50.

Figure 2:
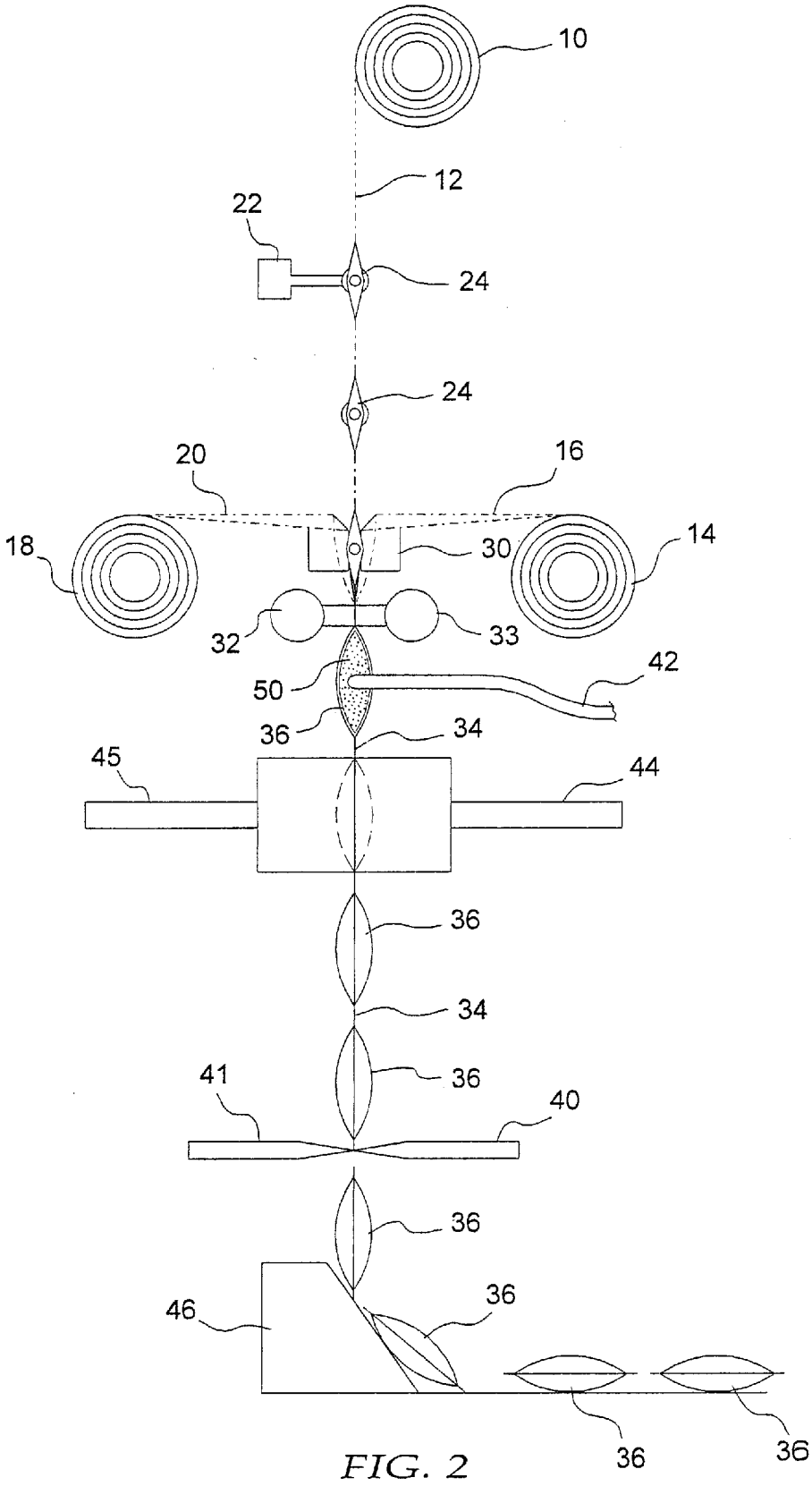
FIG. 2 is a schematic view in elevation of the form/fill process and apparatus showing the filling end of the sachets.

FIG. 2 is a plan view of the opposite side of the form/fill apparatus and process of FIG. 1. This figure shows film 12 advancing from roll 10 to station 22 for that attachment of dispensing outlet 24. This film 12 with the dispensing outlet attached moves to sachet former 30 which orients films 16 and 20 into contact with film 12 and dispensing outlet 24. Films 16 and 20 are bonded to the dispensing outlet at this point. The lateral edges of the three films of the sachet then are formed by sealing jaws 32, 33. The sachet then is fully formed except for the open bottom. Next, the sachet 36 is bottom filled with substance 50 by filler tube 42. In the next station sealing jaws 44, 45 crimp seal close the bottom of the sachet. The sachet now is formed and filled. A closure for the nozzle will be in place in the bottom filling operation. The sachets are severed, one from the other by jaws 40, 41 and deflected to a packing carton. Optionally they can be perforated at the common side seals and severed in a plurality or string of n sachets where n is an integer of about 2 to 50.

Figure 3:
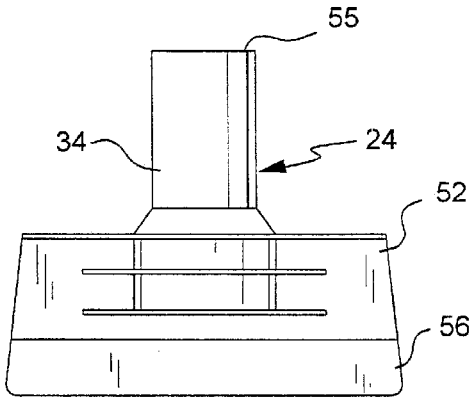
FIG. 3 is a side elevational view of a dispensing outlet showing a projecting wall for attachment to a film.
Figure 3A:
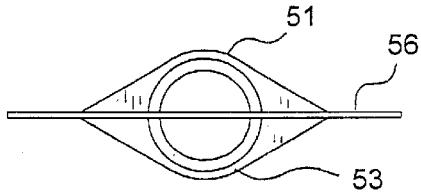
FIG. 3A is a bottom plan view of the dispensing outlet of FIG. 3.

FIGS. 3 and 3A are a view of one embodiment of the nozzle 24 for the sachet. Base walls 52 on either side provide a surface for the attachment of the outer wall films 16 and 20 to the nozzle. Ledge 56 projects downward to a point intermediate the base walls 52 and is for attachment of divider wall film 12 by adhesive or heat sealing. There is a dispensing channel 51 and 53 on either side of this ledge 56.

Figure 4:
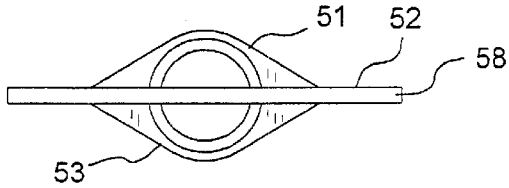
FIG. 4 is a bottom plan view of a dispensing outlet showing a resess for attachment to a film.

FIG. 4 is a bottom plan view of an alternate embodiment of the dispensing nozzle of FIG. 3. The difference here is that in place of ledge 56 on the divider wall 57, there is a recess 58 in the divider wall. The divider wall film 10 will enter this recess 58 and be attached to the nozzle by adhesive or heat sealing. This recess is between dispensing channels 51 and 53.

Figure 5:
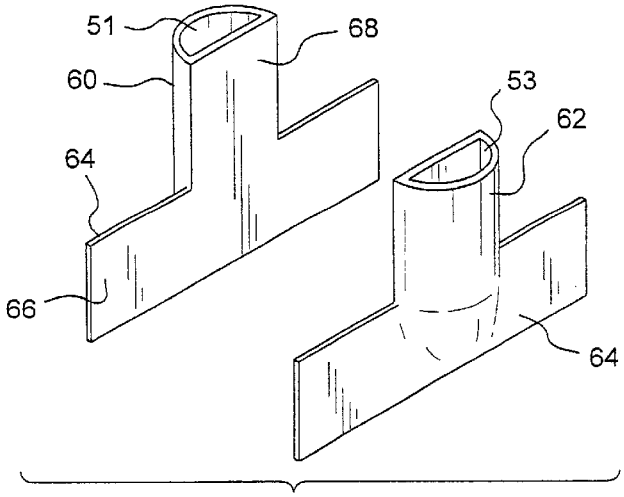
FIG. 5 is a perspective view of two half nozzles each with a divider wall.

FIG. 5 discloses a further embodiment of the dispensing nozzle. Here the nozzle is comprised of two vertical sections 60 and 62. Each horizontal section has a base wall 64 for the attachment of the outer wall films 16 and 20 of the sachet on an outer surface. Further, the base walls 64 have facing surfaces 66 which attach to the divider wall film 12 on either side of the divider wall film. The facing surfaces 66 base walls 64 extend up through the nozzle channel portion 68 to provide two separate dispensing channels 51 and 53.

Figure 6:
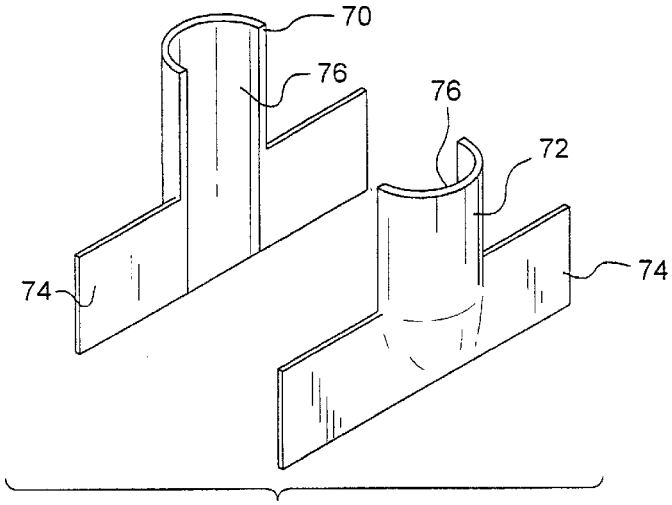
FIG. 6 is a perspective view of two half nozzles each without a divider wall.

FIG. 6 shows a further embodiment of the nozzle 24. Here the nozzle is in two vertical sections 70 and 72 with open channels 76. Each has a base portion 74 for attachment on the outer surface to sachet films 16 and 20 and on edges of channels 76 for attachment inner surface 76 to the divider wall film 12. In this variation the nozzle channels 76 are open with no divider wall, or if divider wall film 12 extends to the nozzle outlet, a divider wall in the nozzle will be comprised of divider wall film 12. In this latter variation the sealed walls in the area of the nozzle can be trimmed to better expose the nozzle.

Figure 7:
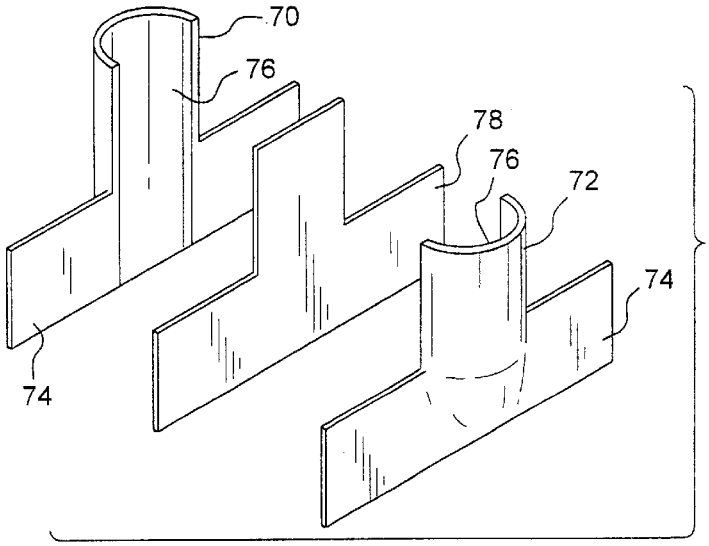
FIG. 7 is a perspective view of a three piece nozzle.

FIG. 7 shows a further variation of the nozzle 24. The nozzle is comprised of three sections 70, 72 and 78. This nozzle is similar to that of FIG. 6 but with the addition of a divider wall 78. Divider section 78 can be bonded to section 70 or 72 and then these sections bonded to divider wall film 12 in making the sachet. There are two dispensing channels 76.

Figure 8:
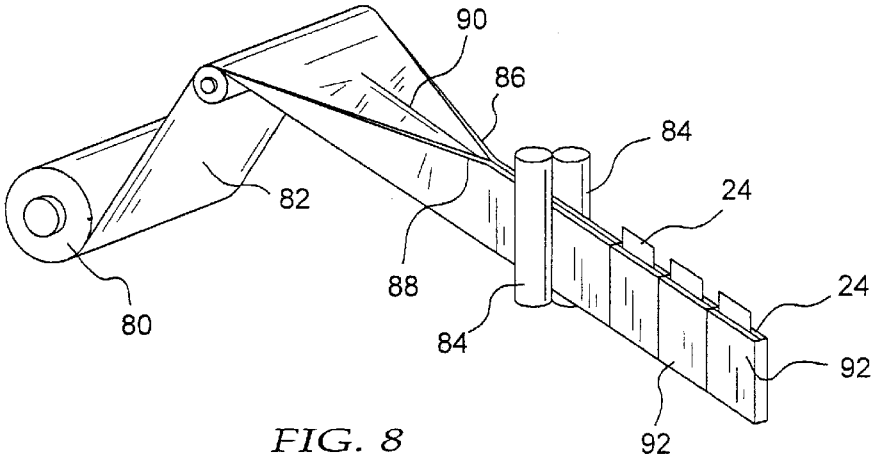
FIG. 8 is a schematic view of sachets being made from a single film source.
Figure 9:
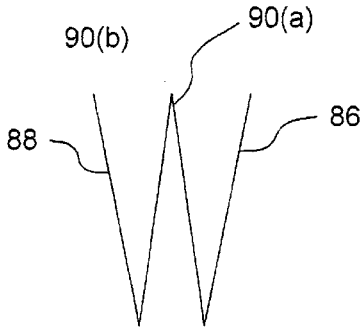
FIG. 9 is a view of film in a "W" shape as formed in the process of FIG. 8.

FIGS. 8 and 9 illustrate the making of the present sachet from a single sheet of film 82 from roller 80. The film 82 is formed into a "W" shape as illustrated in FIG. 9 and passes by forming rollers 84. The nozzle 24 is inserted and attached to the junction of divider wall third film 90(*a*) and fourth film 90(*b*). These then are formed into separate sachets 92 by sealing horizontal edges 94 and the nozzle to walls 86 and 88. This differs from the sachet produced by the process of FIGS. 1 and 2 in that there will be a double ply divider wall of third film 90(*a*) and fourth film 90(*b*). The lower closed ends can be severed for filling and then resealed or the sachets can be top filled through the nozzle. In any severing it is preferred that the junction of the third and fourth film inner divider walls not be severed.

Figure 10:
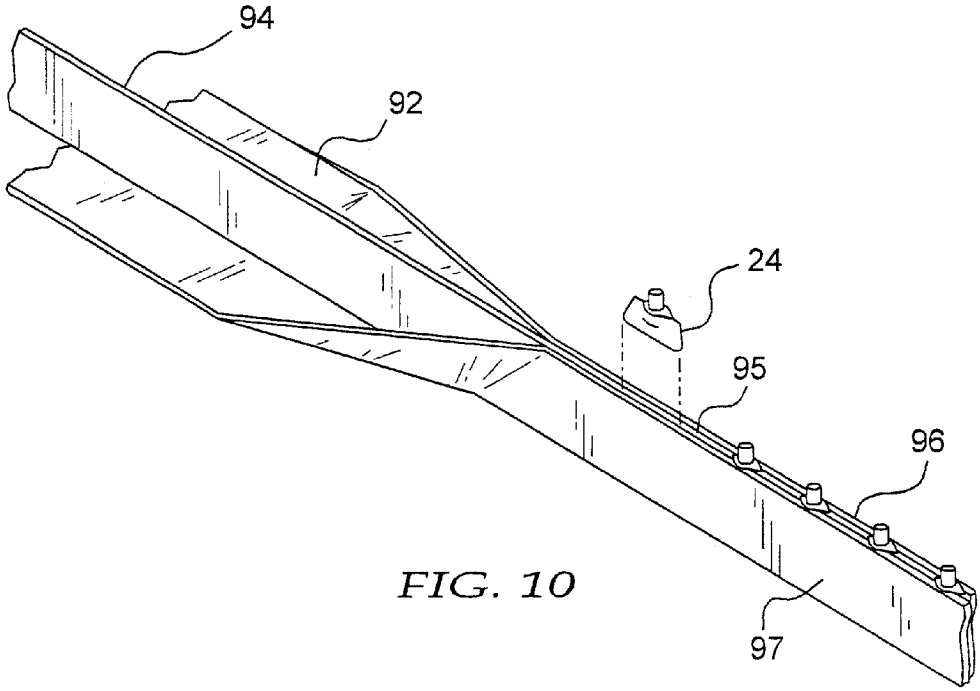
FIG. 10 is a schematic view of a process for making a sachet from two film sources.

FIG. 10 shows a sachet made from two rolls of film. A first roll of film will provide film 92 which is folded to form a V-shape. A second film 94 from a second film roll is inserted into the center of the V-shape to form the divider wall. The nozzle is attached to this second film divider wall in the same manner as in FIGS. 1 and 2 and the subsequent processing is the same as in FIGS. 1 and 2.

It is shown that the sachet can be made from one, two or three rolls of film. Regardless of the way the sachet is made the nozzle is attached to the divider wall to provide for a reclosable dispenser. It also is a dispenser that is conducive to form/fill operations which provides for greater efficiencies.

The films and the dispensing outlet must be of materials that will form relatively strong bonds one to the other. Preferred materials are the polyolefins. These unsaturated noncyclic polymers such as polyethylenes, polypropylenes, polybutenes, polybutadienes, polypentenes and higher hydrocarbons. These include the various vinyl polymers.

The films will be of a thickness of about 60 microns to about 350 microns, and preferably about 70 microns to about 150 microns. Preferably the divider wall film will have a greater flexibility than that of the outer wall films but can be of a rigid plastic material.

Typically in use the sachet will be opened usually by a flip top, friction fit or a screw cap, and the contents dispensed by squeezing the outer walls of the sachet. After dispensing the cap is screwed back onto the dispensing outlet.

The foregoing describes the embodiments preferred at the present time. The concept of the present invention is not to be limited by the preferred embodiments.

What is claimed is:

1. A method for producing and filling a multichamber sachet comprising:

providing at least two sources of film, a first film forming outer film walls, a second film forming an inner film divider wall;

providing a nozzle dispenser outlet having an upper part and a lower part and at least two dispensing channels extending from said lower part through said upper part;

advancing said inner film divider wall and attaching an edge of said inner film divider wall to said lower part of said nozzle intermediate said at least two dispensing channels;

folding said first film into a U-shape to form the outer film walls;

advancing said inner film divider wall with said dispensing outlet attached thereto into contact with said outer film walls;

attaching said outer film walls to exterior surfaces of said dispensing outlet;

sealing the lateral edge portions of said outer walls, and said inner film divider wall together to form a sachet; and severing an end of said sachet opposite said nozzle to form an opening;

filling said sachet with a substance;

sealing the end of said sachet opposite said nozzle outlet; and severing said sachets to provide a string of n sachets where n is an integer of about 2 to 50.

2. A method as in claim 1 wherein said dispensing outlet is a reclosable outlet.

3. A method as in claim 1 wherein said nozzle has a recess on said lower part thereof, said recess receiving said inner film divider wall and being bonded to said inner film divider wall.

4. A method as in claim 1 wherein said nozzle has a projection on a lower part thereof, said projection being bonded to said inner film divider wall.

5. A method as in claim 1 wherein said nozzle is comprised of two horizontal sections, each horizontal section having one of said two dispensing channels, positioning each of said horizontal sections on an opposite side of said inner film divider wall and attaching each of said horizontal sections on a lower part thereof to said inner divider wall.

6. A method as in claim 1 wherein said nozzle is comprised of two horizontal sections, each horizontal section having a portion of said two dispensing channels, positioning each of said horizontal sections on an opposite side of said inner film divider wall an attaching each of said horizontal sections on a lower part thereof to said inner divider wall.

7. A method as in claim 1 wherein said nozzle is comprised of three horizontal sections. A first and a second horizontal section having a portion of said two dispensing channels and a third horizontal section comprising a substantially planar divider wall, attaching said substantially planar divider wall to one of said first and second horizontal sections, positioning each of said first and second horizontal sections on an opposite side of said inner film divider walls and attaching each of said horizontal sections on a lower part thereof to said inner divider wall.

8. A method as in claim 1 wherein said substance is selected from the group consisting of shampoos, lotions and dentifrices.

* * * * *